US007804966B2

(12) United States Patent
Adams et al.

(10) Patent No.: US 7,804,966 B2
(45) Date of Patent: Sep. 28, 2010

(54) AUDIO AMPLIFIER ATTACHABLE TO SPEAKER SYSTEM BY WAY OF MAGNETIC COUPLER AND METHOD THEREFOR

(75) Inventors: Charles Clifford Adams, Gilbert, AZ (US); Dale Vernon Curtis, Scottsdale, AZ (US); Jerry Kenneth Hubbard, Chandler, AZ (US); Eric Matthew Miller, Phoenix, AZ (US)

(73) Assignee: Fender Musical Instruments Corporation, Scottsdale, AZ (US)

( * ) Notice: Subject to any disclaimer, the term of this patent is extended or adjusted under 35 U.S.C. 154(b) by 1680 days.

(21) Appl. No.: 11/018,010

(22) Filed: Dec. 20, 2004

(65) Prior Publication Data

US 2006/0133625 A1 Jun. 22, 2006

(51) Int. Cl.
*H04R 1/02* (2006.01)

(52) U.S. Cl. ..... 381/87; 381/386; 381/120; 381/332

(58) Field of Classification Search ..... 381/336, 381/150, 87, 120, 118, 332, 334, 386; 181/150, 181/148, 199, 30, 145; 84/726, 723, 737, 84/327, 645

See application file for complete search history.

(56) References Cited

U.S. PATENT DOCUMENTS

| | | | | |
|---|---|---|---|---|
| 4,843,624 | A * | 6/1989 | Rashak | 381/91 |
| 5,900,715 | A * | 5/1999 | Roberts | 320/115 |
| 6,357,887 | B1 * | 3/2002 | Novak | 362/26 |
| 7,256,342 | B2 * | 8/2007 | Hagiwara et al. | 84/726 |
| 7,328,769 | B1 * | 2/2008 | Adamson | 181/199 |

* cited by examiner

*Primary Examiner*—Vivian Chin
*Assistant Examiner*—Disler Paul
(74) *Attorney, Agent, or Firm*—Robert D. Atkins

(57) ABSTRACT

An audio amplifier and speaker system are stacked and magnetically coupled together. The audio amplifier is coupled for receiving an audio signal. A first securing assembly is provided on a bottom surface of the amplifier. The first securing assembly may be a foot formed on the bottom surface of the audio amplifier. The speaker is electrically coupled to the amplifier. A second securing assembly is provided on a top surface of the speaker. The second securing assembly may be a receptacle formed in top surface of the speaker. The foot is inserted into the receptacle. The foot and receptacle are magnetically coupled to attach the amplifier to the speaker. The foot has a first electrical connector, and the receptacle has a second electrical connector mated to the first electrical connector to route the audio signal from the amplifier to the speaker.

5 Claims, 5 Drawing Sheets

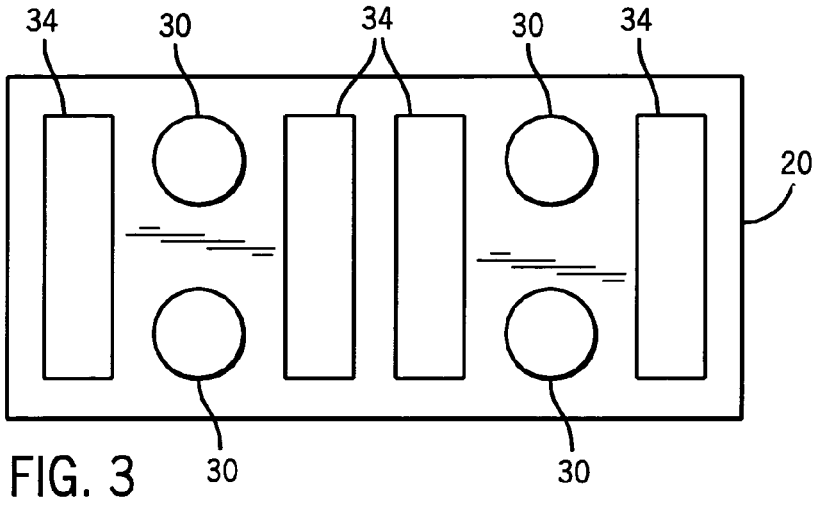
FIG. 3
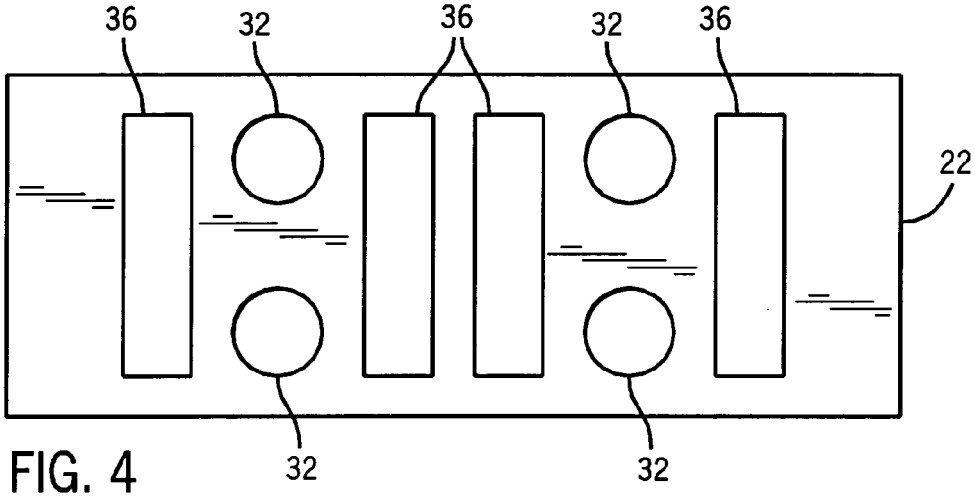
FIG. 4
FIG. 7
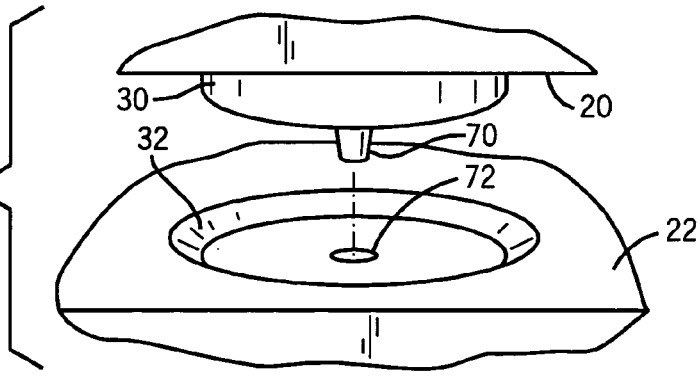

AUDIO AMPLIFIER ATTACHABLE TO SPEAKER SYSTEM BY WAY OF MAGNETIC COUPLER AND METHOD THEREFOR

FIELD OF THE INVENTION

The present invention relates in general to audio sound systems and, more particularly, to an audio amplifier attachable to a speaker system by way of a magnetic coupler.

BACKGROUND OF THE INVENTION

Audio amplifiers and speakers for entertainment systems can take a variety of forms. In one case, musical instruments generate electrical audio signals representative of sounds produced by the instrument. Electric guitars and electric bass guitars are well-known musical instruments. The artist plays the guitar and generates electric signals representative of the intended notes and chords. In another case, the audio signals may be generated from vocals through a microphone. The electrical signals are routed through one or more audio amplifiers for pre-amplification, power amplification, filtering, and other signal processing to enhance the tonal quality and properties of the signal. The processed signals then drive a speaker system to generate or reproduce the original sound from the musical instrument for the audience.

The audio amplifier and speaker system may be arranged in one integrated unit, or may be housed in separate units or enclosures. Higher-end systems generally have separate audio amplifier and speakers components. When the user sets up the audio amplifier and speaker system, the individual units are placed in proximity to one another and then electrically connected. The speaker may be placed on the floor and the audio amplifier may be placed on a table. If no other sturdy platform or surface is available, the audio amplifier can be stacked or placed on top of the speaker. The musical instrument is plugged into the audio input jack of the amplifier, and the audio output of the amplifier is electrically connected to the speaker with external cabling. The instrument and speaker cabling may be long and is usually draped over objects or laid on the floor.

In cases where the audio amplifier is stacked on the top surface of the speaker, there is generally little or no securing mechanism between the components. The audio amplifier remains in place primarily due to the effects of gravity and any lip or edge around the top of the speaker. The top of the speaker may have a non-skid surface, but there is little less holding the audio amplifier in place.

In the event that the stacked audio amplifier and speaker units are bumped, the audio amplifier can be knocked off the speaker. If the electrical cable between the musical instrument and audio amplifier is pulled, e.g., someone trips over the cable or the artist wanders too far from the amplifier while carrying the instrument, then the audio amplifier can be pulled off the speaker. Since the speaker is generally a heavier component, the audio amplifier will dislodge and fall off before the speaker moves or tips over. The audio amplifier may be damaged if it strikes the floor with sufficient force.

A need exists to secure the audio amplifier to the speaker when the components are stacked.

SUMMARY OF THE INVENTION

In one embodiment, the present invention is an audio sound system comprising an audio amplifier coupled for receiving an audio signal. A speaker is electrically coupled to the audio amplifier for converting the audio signal to audible sounds. A first securing assembly is provided on a surface of the audio amplifier. A second securing assembly is provided on a surface of the speaker. The first and second securing assemblies are magnetically coupled to attach the audio amplifier to the speaker.

In another embodiment, the present invention is an audio sound system comprising a first enclosure housing an audio amplifier. A surface of the first enclosure has a first securing assembly. A second enclosure houses a speaker. A surface of the second enclosure has a second securing assembly which is adapted for magnetically coupling to the first securing assembly to attach the first enclosure to the second enclosure.

In another embodiment, the present invention is an audio sound system comprising a first enclosure housing an audio amplifier. A second enclosure houses a speaker. A securing assembly attaches a flat surface of the first enclosure to a flat surface of the second enclosure.

In another embodiment, the present invention is a method of attaching an audio amplifier to a speaker comprising providing a first enclosure housing an audio amplifier, providing a second enclosure housing a speaker, and magnetically coupling a surface of the first enclosure to a surface of the second enclosure

BRIEF DESCRIPTION OF THE DRAWINGS

FIG. 3 illustrates a bottom view of the audio amplifier with feet and metallic strips;

FIG. 4 illustrates a top view of the speaker system with receptacles and metallic strips;

FIG. 7 illustrates a foot and receptacle assembly with electrical connectors.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
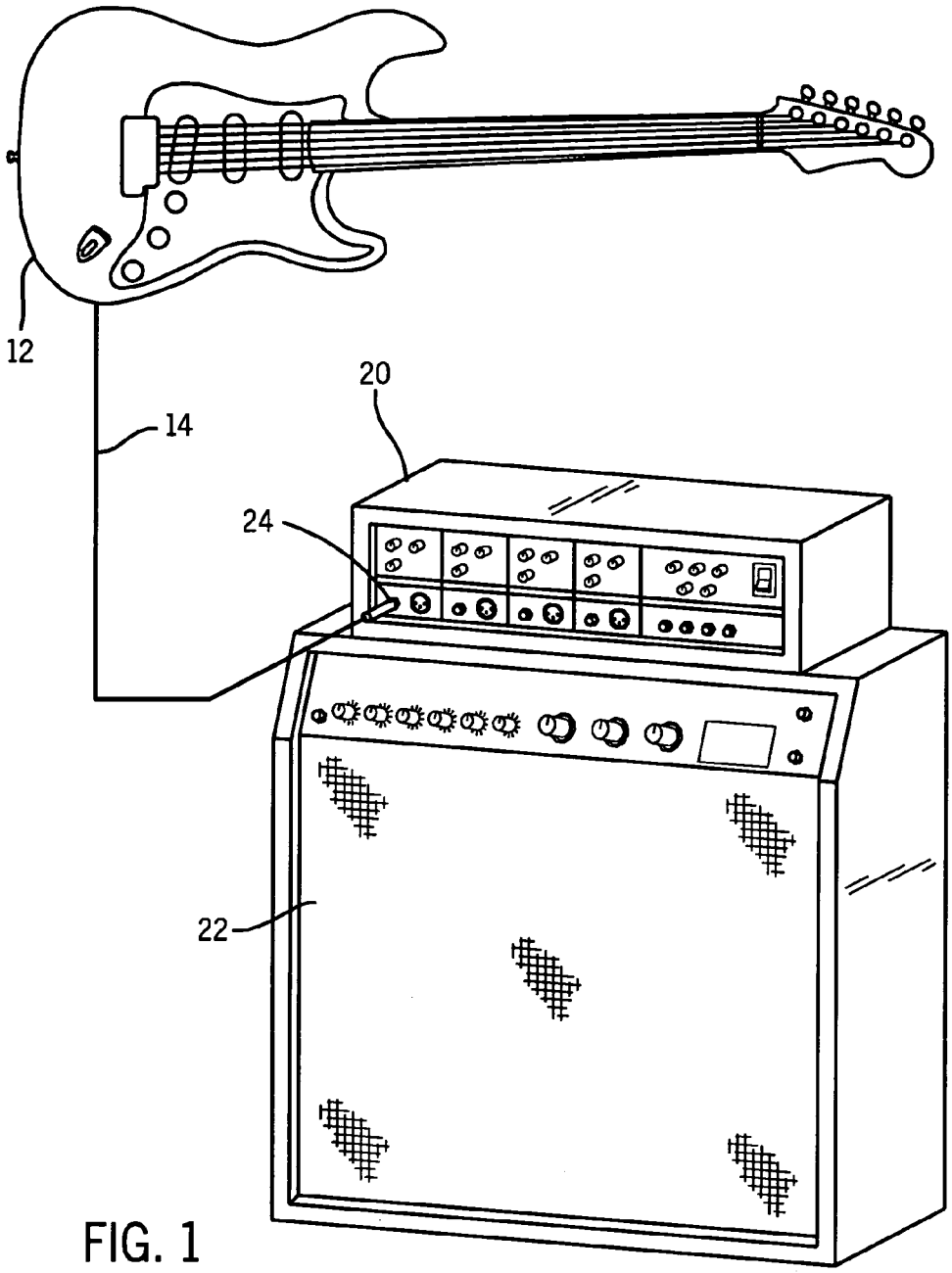
FIG. 1 illustrates a guitar connected to an audio sound system.

Referring to FIG. 1, a musical instrument such as electric guitar 12 is shown with an audio output cable 14. In other embodiments, the musical instrument may be an electric bass guitar, violin, drums, electric keyboard, audio microphone, or other instrument generating electric signals representative of sound content. Guitar 12 generates an electric signal representative of the produced sounds, which is sent to audio amplifier 20 for signal conditioning and power amplification. The audio output of amplifier 20 is electrically connected to speaker system 22, i.e., audio cable 14 plugs into audio input jack 24 on the front panel of audio amplifier 20. The signal conditioning may include amplification, equalization, filtering, special effects, and other signal processing functions. The power amplification increases the power level and signal strength of the audio signal to drive speaker 22 and reproduce the original sound from the musical instrument.

Figure 2:
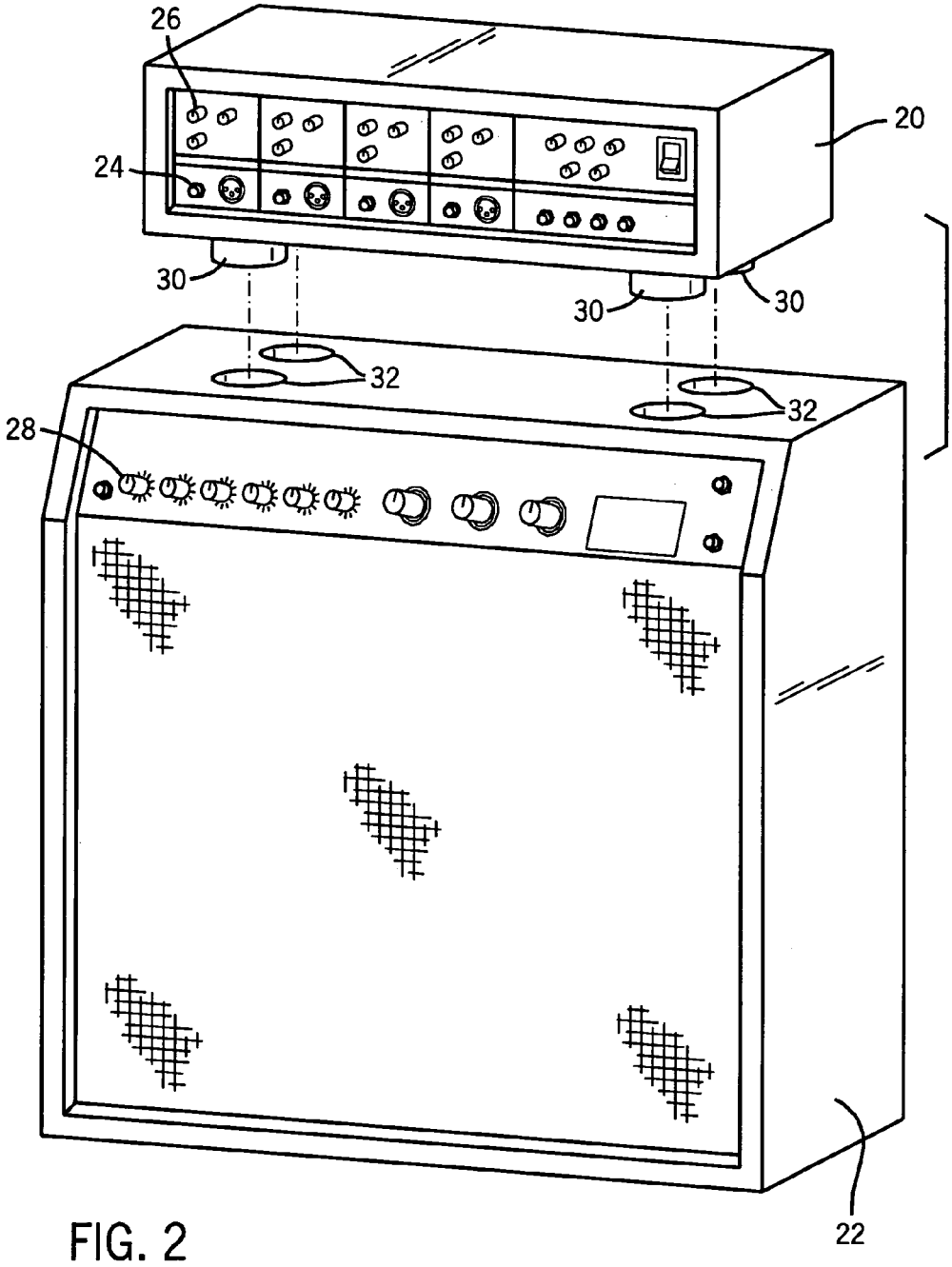
FIG. 2 illustrates an audio amplifier aligned with the speaker system and secured with a magnetic coupler.

Turning to FIG. 2, audio amplifier 20 is shown as a separate component or unit from speaker 22. Audio amplifier 20 and speaker 22 are each housed in their respective enclosures. Audio amplifier 20 has a control panel 26 for selecting features such as amplification, equalization, balance, and other tonal qualities and properties of the audio signal. Speaker 22 also may have a control panel 28 for selecting speaker control functions. Audio amplifier 20 may output 250 watts of power to speaker 22.

The enclosure of audio amplifier 20 has a substantially flat bottom surface, aside from feet 30. Likewise, the enclosure of speaker 22 has a substantially flat top surface, aside from receptacles 32. The bottom surface of audio amplifier 20 has four circular feet 30. In one embodiment, each foot 30 is about 1.0-2.0 inches in diameter and 0.75 inches in height. The top surface of speaker 22 has four receptacles 32 slightly larger than feet 30. The feet 30 on the bottom surface of audio amplifier 20 are designed to mate with receptacles 32 on the top surface of speaker 22. As feet 30 are inserted into receptacles 32, the flat bottom surface of audio amplifier 20 comes flush in contact with, or in close proximity to, the flat top surface of speaker 22.

FIG. 3 illustrates the bottom surface of audio amplifier 20. The feet 30 are located in proximity to, or relatively spaced with respect to, the four corners of the bottom surface. FIG. 4 illustrates the top surface of speaker 22. The receptacles 32 are spaced in geometrically the same position as feet 30 so that the center of mass of audio amplifier 20 is substantially over the center of speaker 22. As feet 30 are inserted into receptacles 32, audio amplifier 20 is properly positioned on the top of speaker 22 for optimal stability and balance.

The bottom surface of audio amplifier 20 is secured to the top surface of speaker 22 by way of a magnetic coupling. In one embodiment, feet 30 contain magnets, or are magnetically charged, with a first polarity, e.g., positive polarity. In a similar manner, receptacles 32 are neutral metal or magnetically charged with a second polarity opposite to the first polarity, e.g., negative polarity. Feet 30 and receptacles 32 may respectively be given the opposite magnetic charges from that described above. By bringing feet 30 in close proximity of and inserting into receptacles 32, the magnetic force between the opposing attractive polarities causes the audio amplifier 20 to be secured attached or held to speaker 22.

The securing assembly between audio amplifier 20 and speaker 22 is embodied as a magnetically coupled feet and receptacles assembly. The feet portion of the assembly may be provided on audio amplifier 20 or the feet portion may be on speaker 22. Likewise, the receptacle portion of the assembly may be provided on audio amplifier 20 or the receptacle portion may be on speaker 22. In any case, it is the magnetic force between feet 30 and receptacles 32 that securely holds audio amplifier 20 to speaker 22.

In another embodiment, metallic strips are disposed along the length, width or depth of the bottom surface of audio amplifier 20 and likewise along the top surface of speaker 22. In FIG. 3, metallic strips 34 are disposed across the depth of the bottom surface of audio amplifier 20, and metallic strips 36 are disposed across the depth of the top surface of speaker 22. Metallic strips 34 and/or metallic strips 36 can be magnetized with attractive polarities. In this case, the magnetic strips 34 and 36 hold audio amplifier 20 to speaker 22, while feet 30 and receptacles 32 operate as alignment guides and provide shear strength to the union between the components. The magnetic coupling may be external or internal to the enclosures.

In some audio sound systems, the speaker system may be stacked on top of the audio amplifier, in which case a bottom surface of the speaker system is secured to a top surface of the amplifier by way of the magnetic coupling.

Figure 5:
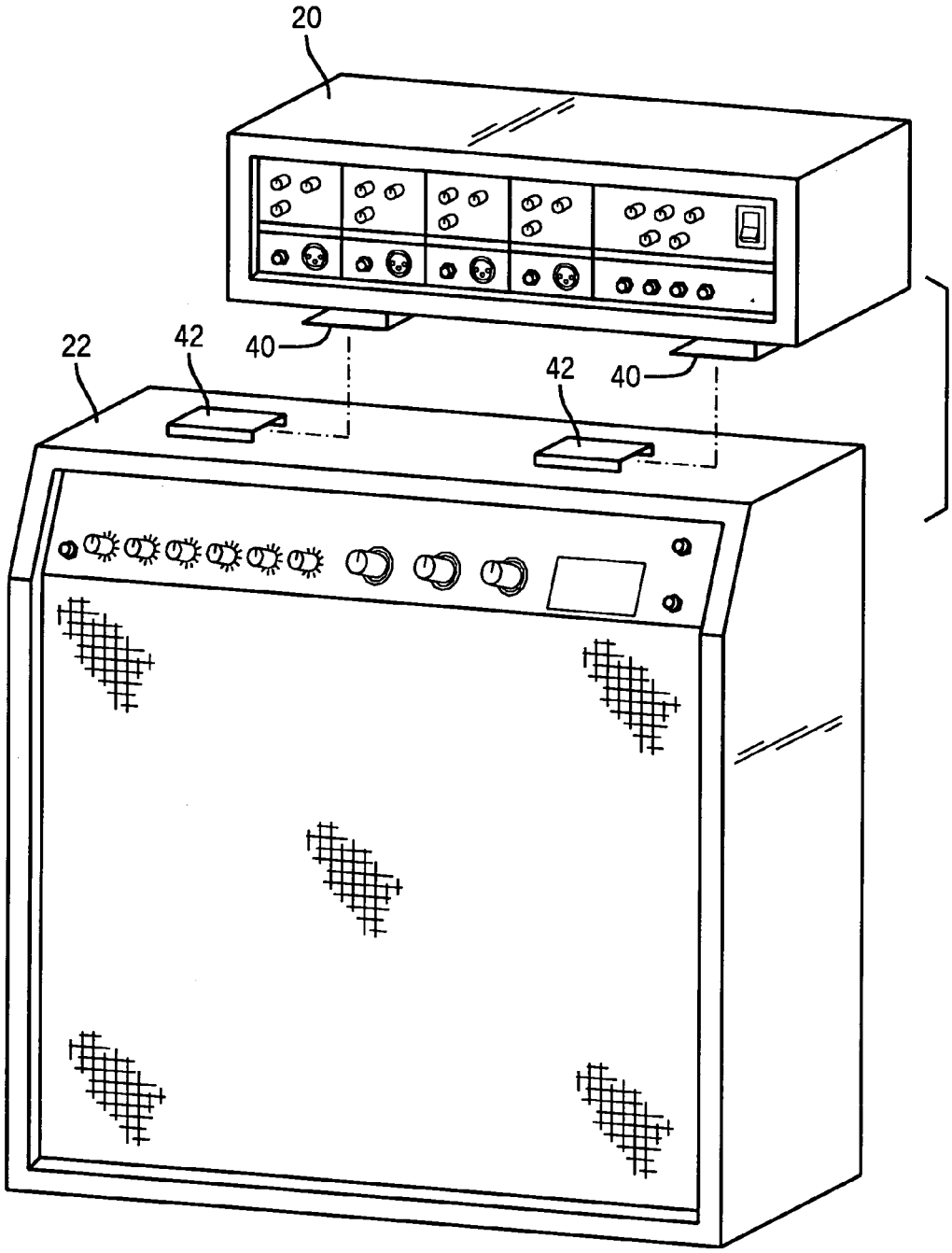
FIG. 5 illustrates the audio amplifier aligned with the speaker system for securing with tongue and slot assembly.
Figure 6:
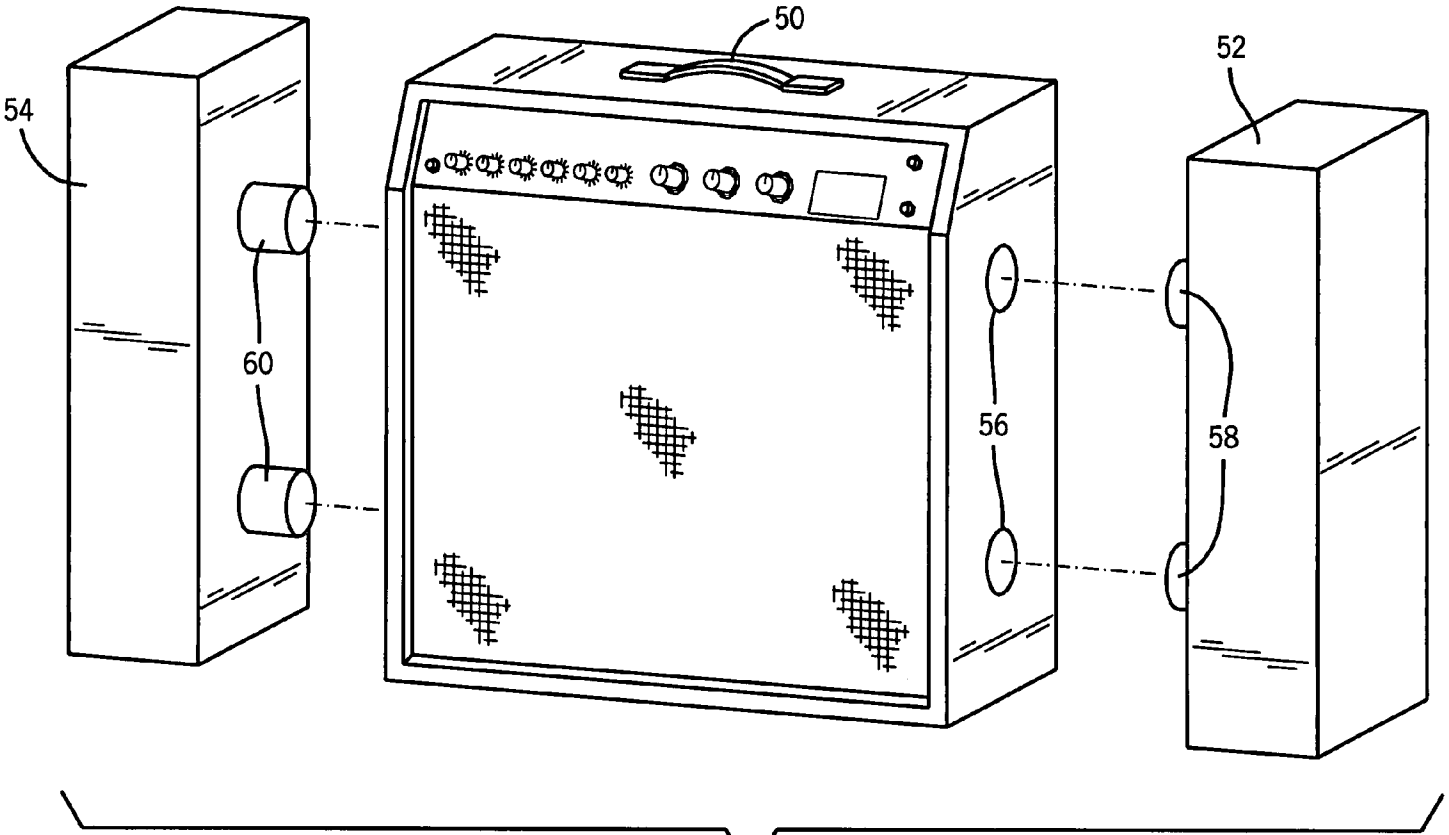
FIG. 6 illustrates speakers secured to the sides of the audio amplifier with magnetic couplers.

The magnetic coupling between audio amplifier 20 and speaker 22 is one embodiment of the securing mechanism or assembly between the components. Another securing mechanism is shown in FIG. 5. Brackets or tongues 40 are formed in or coupled to the bottom surface of audio amplifier 20. Slots or grooves 42 are provided on the top surface of speaker 22. The brackets and slots may be exchanged between the opposite surfaces. To mount the components, the bottom surface of audio amplifier 20 is placed to the side and in vertical proximity to the top surface of speaker 22. The end of brackets 40 are aligned to the opening of slots 42. Brackets 40 slide into slots 42 in a horizontal direction until the brackets are completely contained within the slots. The center of mass of audio amplifier 20 should then be centered over the top surface of speaker 22. The brackets 40 contained in the slots 42 keep audio amplifier 20 securely attached to speaker 22. As an additional securing measure, a clip or latch on one end of audio amplifier 20 keeps brackets 40 from slipping out of slots 42.

Another example of the securing assembly involves the use of Velcro disposed on the joining surfaces between audio amplifier 20 and speaker 22. The Velcro can be used in conjunction with the feet and receptacle alignment assembly. The Velcro provides retaining strength against vertical and shear forces asserted on the audio amplifier.

In another embodiment, audio amplifier 50 is adapted to receive side-mounted speakers 52 and 54. Audio amplifier 50 has receptacles 56. Speaker 52 has feet 58. Feet 58 and receptacles 56 are magnetically charged such that when speaker 52 is brought into proximity to audio amplifier 50, the feet 58 are inserted into receptacles 56 and the components are securely held together by the attractive magnetic forces. Likewise, speaker 54 has feet 60 which insert into receptacles like 56 on the opposite side of audio amplifier 50. As speaker 54 is brought into proximity to audio amplifier 50, the feet 60 are inserted into the receptacles and the components are securely held together by the attractive magnetic forces.

The feet and receptacle assembly provides a precise alignment between audio amplifier 20 and speaker 22. Accordingly, an electrical connection can be made between each foot 30 and corresponding receptacle 32. As shown in FIG. 7, as foot 30 is inserted into receptacle 32, male electrical connection 70 is inserted into female electrical connection 72, which makes electrical contact therebetween. With four separate foot/receptacle pairs, at least four electrical connections can be made between audio amplifier 20 and speaker 22. The electrical conductor within electrical connection 70 is electrically isolated from the remainder of foot 30. Likewise, the electrical conductor within electrical connection 72 is electrically isolated from the remainder of receptacle 32. The electrical conductors within electrical connections 70 and 72 route the audio signal from audio amplifier 20 to speaker 22. Since the physical contact between electrical connection 70 and electrical connection 72 is blind as foot 30 is inserted into receptacle 32, and to aid in mating the electrical connections, each electrical connection pair are made conical in shape as mirror images of one another. Otherwise, insertion guides are provided to align electrical connection 70 with electrical connection 72.

The electrical connections within the foot/receptacle assemblies allow audio signals from audio amplifier 20 to be routed to speaker 22, which is an improvement over the external electrical cable connections between audio amplifier 20 and speaker 22. With the electrical connections within the foot/receptacle assemblies, no external electrical cable connections need to be made to electrically connect audio amplifier 20 to speaker 22. The necessary electrical connections between the components are automatically made through the foot/receptacle assemblies when the amplifier is stacked on top of and magnetically coupled to the speaker.

While one or more embodiments of the present invention have been illustrated in detail, the skilled artisan will appreciate that modifications and adaptations to those embodiments may be made without departing from the scope of the present invention as set forth in the following claims.

What is claimed is:

1. An audio sound system, comprising:

an audio amplifier coupled for receiving an audio signal, the audio amplifier having a surface containing a plurality of feet, the feet extending above the surface of the audio amplifier; and a speaker electrically coupled to the audio amplifier for converting the audio signal to audible sounds, the speaker having a surface containing a plurality of receptacles, the receptacles extending below the surface of the speaker, the receptacles being aligned with the feet to position a center of mass of the audio amplifier with respect to a center of the speaker;

wherein the feet are mated to the receptacles which provides shear strength between the surfaces of the audio amplifier and speaker, the feet and receptacles being magnetically coupled to secure the audio amplifier to the speaker.

2. The audio sound system of claim 1, wherein the feet include a first electrical connector.

3. The audio sound system of claim 2, wherein the receptacles include a second electrical connector for connecting to the first electrical connector to route the audio signal from the audio amplifier to the speaker.

4. The audio sound system of claim 1, wherein the feet and receptacles are positioned proximate to four corners of the surfaces of the audio amplifier and speaker.

5. The audio sound system of claim 1, wherein the feet and receptacles are circular.

* * * * *